United States Patent [19]

Takabayashi

[11] 4,086,686

[45] May 2, 1978

[54] PLASTIC CLIP

[75] Inventor: Teruo Takabayashi, Kyoto, Japan

[73] Assignee: Kohshoh Limited, Kyoto, Japan

[21] Appl. No.: 742,642

[22] Filed: Nov. 17, 1976

[30] Foreign Application Priority Data

Feb. 24, 1976 Japan ..... 51-21219[U]

[51] Int. Cl.[2] ..... A44B 21/00

[52] U.S. Cl. ..... 24/250; 16/DIG. 13

[58] Field of Search ..... 24/248 R, 250 R, 252 R, 24/137 R, 137 A, 253; 16/DIG. 13, 171

[56] References Cited

U.S. PATENT DOCUMENTS 2,532,127 11/1950 Stevenson ..... 24/250 R 3,362,052 1/1968 Uchida ..... 24/253

3,914,828 10/1975 Noda ..... 24/250

*Primary Examiner*—Kenneth J. Dorner

[57] ABSTRACT

A plastic clip comprises an upper and lower clip members each of which is provided with a pair of opposed side walls, each of one pair of side walls being extended gradually outwardly and provided with a bearing portion, each of the other pair of side walls having a journal adapted to be fitted into each of the bearing portions whereby the clip members are pivotally connected with each other, a spring means for urging the clip members into the open position and a closing member adapted to change the clip between the open and closed positions.

3 Claims, 10 Drawing Figures

PLASTIC CLIP

The present invention relates to a clip molded of plastic material, said clip being used, for example, on suspenders or braces for connecting the suspenders or braces to trousers, or as laundry clips for fastening laundered underweares and clothing to a clothes lines, and in various other ways.

In the conventional type clip the assembly thereof was complicated, whereas a piece of shaft was made to pass through a bore penetrating through each bearing portion of a pair of bearings provided in each of clip members and then a spring was mounted on each shaft. In assembling this type of clip, the spring was first spaced in a required portion between upper and lower clip members, then the bores penetrating through the bearings of said clip members were arranged in alignment with a passage in the spring for passing the shaft therethrough. After the shaft was passed through said bores and passage, both end portions of the shaft projecting outside of said bores had to be caulked. Thus, much labor and time were spent for assemblying the conventional type clip which made it uneconomical. Further, the caulked shaft ends were likely to damage clothing or the like. Moreover, since both ends of the shaft had to be caulked outside of the adjacent clip members, it was uneconomical in the first place because of the additional processing time and labor, and was also greatly impedimental to a better appearance of the entire clip.

In view of the abovementioned points, the inventor has succeeded in providing a plastic clip which can be assembled without need of the application of such a shaft, and this invention has been disclosed in U.S. Pat. No. 3,780,402. The plastic clip disclosed in the U.S. Pat. No. 3,780,402 comprises an upper and lower clip members and others, in which each clip member is provided with a pair of side walls integrally extended from back parts of longitudinal side edges of the member, and on each of the side walls, a journals or a bearing portion being provided. When pivotally connecting the two clip members with each other, each of the journals is fitted into the corresponding one of bearing portions by urging the side walls of the clip members respectively so that they are in face-to-face relation with each other by using the characteristics of the plastic material. Therefore, this plastic clip can be more easily assembled than a conventional type clip in which such a shaft as abovementioned is applied. However, since the side walls in which bearing portions are provided respectively are formed so as to project vertically, strong pressing force is required for providing the bearing portion therein and sometimes the application of such a strong force gives damage to the side walls.

Further, the bearing portions provided in the vertically projecting side walls are in the form of openings. And it is very difficult to form the bearing portion integrally and at the same time with the side walls. In manufacturing the abovementioned clip, firstly, only the side walls are integrally formed and then the bearing portions in the side walls, which process requires much time and labor.

In view of the these respects, the inventor has succeeded in providing a plastic clip by which the abovementioned disadvantages can be eliminated.

The object of the present invention is to provide a clip whose parts can be manufactured extremely easily and economically, and each of said parts can be assembled very simply and rapidly.

Another object of the present invention is to provide a clip whose appearance is smart and fine.

According to the present invention, a plastic clip is provided, which comprises at least an upper clip member, a lower clip member, a spring means and a closing member.

Each of upper and lower clip members has a pair of opposed side walls integrally extended from back parts of longitudinal side edges of the member. One said pair of side walls are formed so as to project gradually outwardly or divergently and each of the side walls being provided with an integrally formed bearing portion in the form of an opening for rotatably receiving one of the belowmentioned journals. Each of the other pair of side walls has a laterally outwardly extending journal formed integrally therewith, each journal being rotatably received by one of the bearing portions whereby the two clip members are pivotally connected with each other. The spring member is provided between the upper and lower clip members for resiliently urging the clipping end portions thereof apart. The closing member formed in substantially L-shape and having a central opening and a clip-engaging portion is movably mounted adjacent to the rear end portions of the two clip members. The closing member is movable between the first position in which the clip-engaging portion thereof engages each of the clip members adjacent to the rear end portion thereof to hold the rear ends of the clip members apart and the clipping end portions together against the force of the spring and a second position in which the rear end of one clip member extends through the central opening in the closing member whereby the closing member permits the rear ends of the clip members to move toward each other to separate the clipping end portions.

According to the present invention, each of the upper and lower clip members and the closing member are preferably formed integrally of resin material. The upper and lower clip members comprise plate portions respectively and provided with a pair of opposed side walls integrally projecting from back parts of longitudinal side edges of the plate portions. When the pair of side walls of the upper clip member are extended gradually outwardly or divergent from the plate portion to the top of the side wall, a pair of bearing portions are provided integrally with the pair of side walls. Each of the bearing portions comprises an opening for rotatably receiving each of the pair of journals laterally outwardly extending from the lower clip member.

On the other hand, when the pair of side walls are formed only vertical to the plate portion, the pair of journals are formed integrally with these side walls. Each of the journals comprises a laterally outwardly extending projection and is rotatably received by the bearing portion in the form of an opening provided in each side wall of the lower clip member. The projections may be hemispherical or rod-shaped ones. Further, in case of a rod-shaped projection, it may be provided at its top ends with an inclined section for facilitating the fitting of the same into the bearing portion.

Similarly, each of the side walls of the lower clip member is provided with the abovementioned journal or bearing portion. That is, when the side walls of one clip member are provided with bearing portions and extended divergently, the side walls of the other clip member are provided with journals and formed substantially vertical to the plate portion. That is, when the side walls of the upper clip member are provided with bearing portions and extended outwardly or divergently from the plate portion thereof, the side walls of the corresponding lower clip member are provided with journals and formed to be substantially vertical to the plate portion thereof. On the other hand, when the side walls of the lower clip member are provided with journals and formed to be substantially vertical to the plate portion thereof, the side walls of the corresponding lower clip member are provided with bearing portions and extended gradually outwardly or divergently. Further, a guide means comprising a groove or the like is preferably provided from the top portion of each of the side walls to the bearing portion thereof for facilitating the insertion of each journal into the corresponding bearing portion.

The upper and lower clip members thus formed are pivotally connected with each other by inserting each journal into the corresponding bearing portion. The spring means is mounted between the pivotally connected upper and lower members so as to keep the clipping end portions of the members in the open position. The spring means may comprise a spiral spring member or a plate spring member. The spring means is adapted to be mounted by only the insertion thereof between the opposed surfaces of the upper and lower clip members to keep the clipping ends thereof in the open position. That is, the spring member can be secured between the opposed surfaces of the upper and lower members without using a shaft or the like therefor. For mounting the spring means, a recess is provided in and longitudinally of each of the opposed surfaces of the clip members for receiving each end of the spring means.

The substantially L-shaped closing member having the central opening and the clip-engaging portion is movably mounted between the rear end portions of the clip members. The central opening is provided adjacent to the one side of the L-shaped closing member and the clip-engaging portion adjacent to another side thereof. The closing member thus mounted is movable between the first position in which the clipping end portions of the clip members are in the closed position and the second position in which the clipping end portions are in the open position. In the first position, the top end of the clip-engaging portion engages each of the opposed surfaces of the rear end portions of the clip members to hold the rear ends of the clip members apart. In the second position, the clip-engaging portion is free i.e. is not in engagement with any of the opposed surfaces of the rear end portions of the clip members. In this second position, the rear end portion of one clip member extend the central opening in the closing member, whereby the clipping end portions of the clip members are brought into the open position by the force of the spring means to permit the rear end portions of the clip members to move toward each other. Preferably a slit is integrally formed in the rear portion of the closing member for securing one end of a band or the like therethrough when the clip is applied to the latter.

The appended drawings illustrate preferred embodiments of the present invention, in which.

Figure 1:
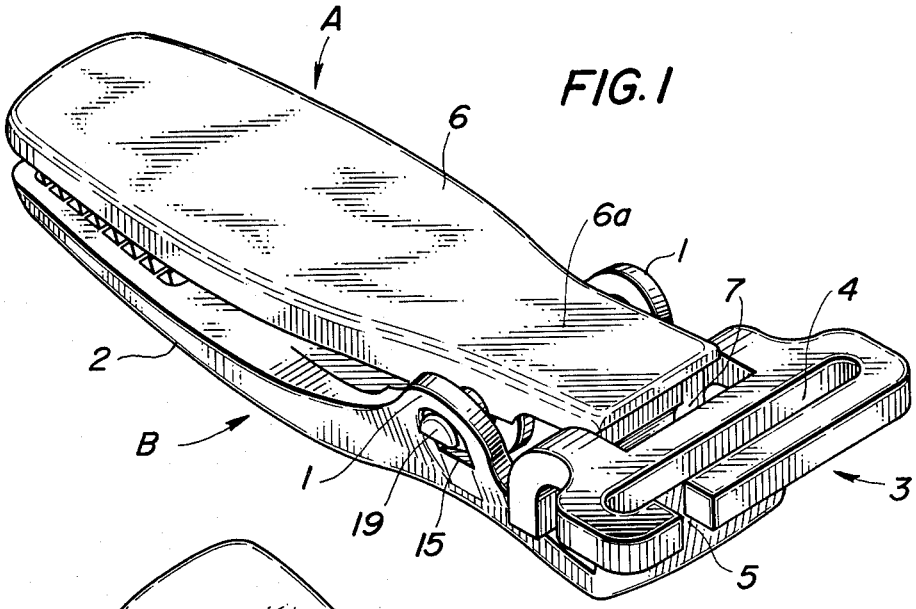
FIG. 1 is a perspective view seen from the rear position of an embodiment of a clip according to the present invention with the clipping end portions in the closed position.
Figure 2:
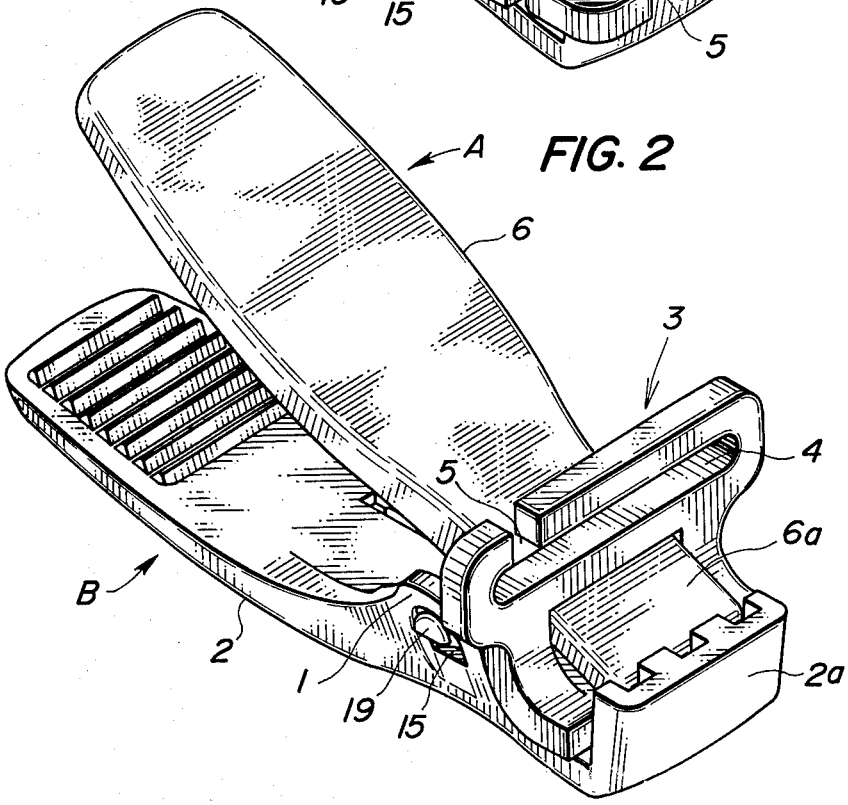
FIG. 2 is a perspective view seen from the rear position of the embodiment of FIG. 1 with the clipping end portions in the open position.
Figure 3:
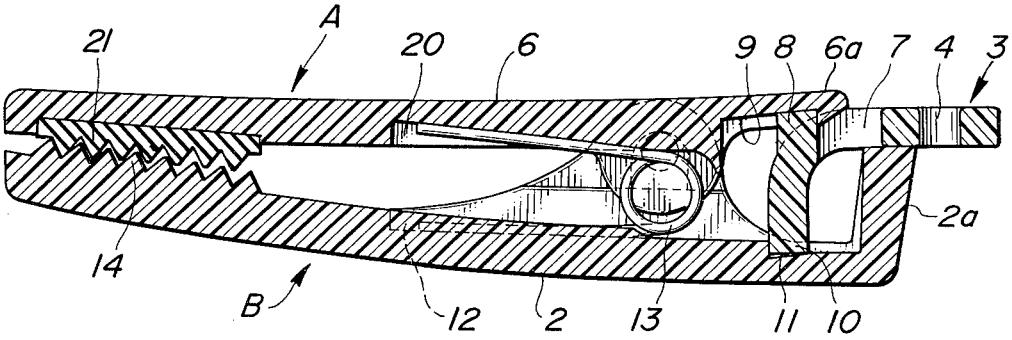
FIG. 3 is a sectional view of the embodiment of FIG. 1 with the clipping-end portions in the closed position.
Figure 4:
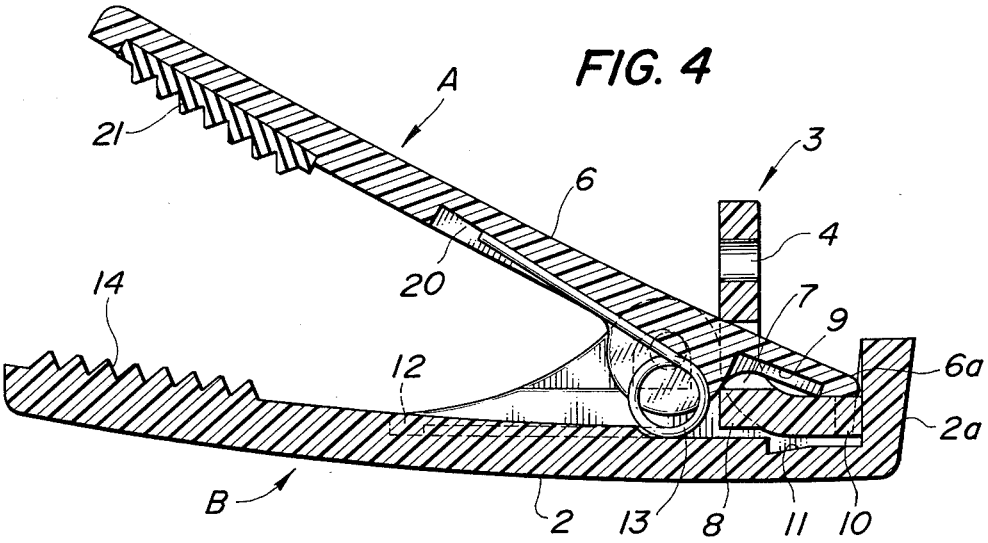
FIG. 4 is a sectional view of the embodiment with the clipping-end portions in the open position.
Figure 5:
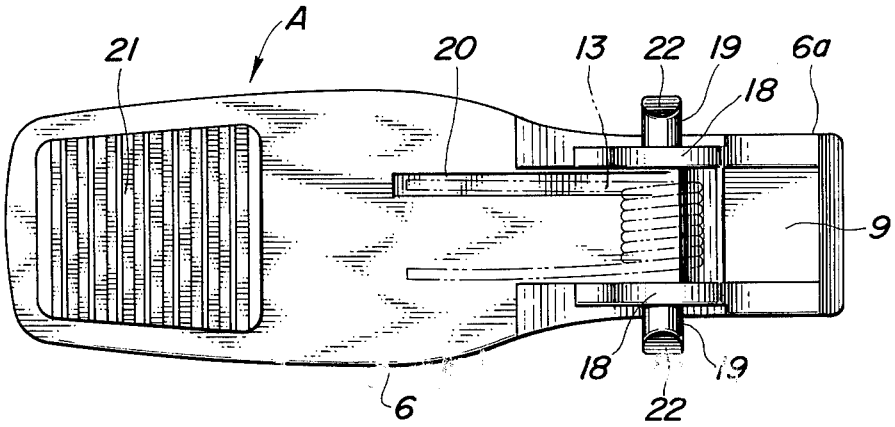
FIG. 5 is a plan view of the upper clip member of the embodiment of FIG. 1.
Figure 6:
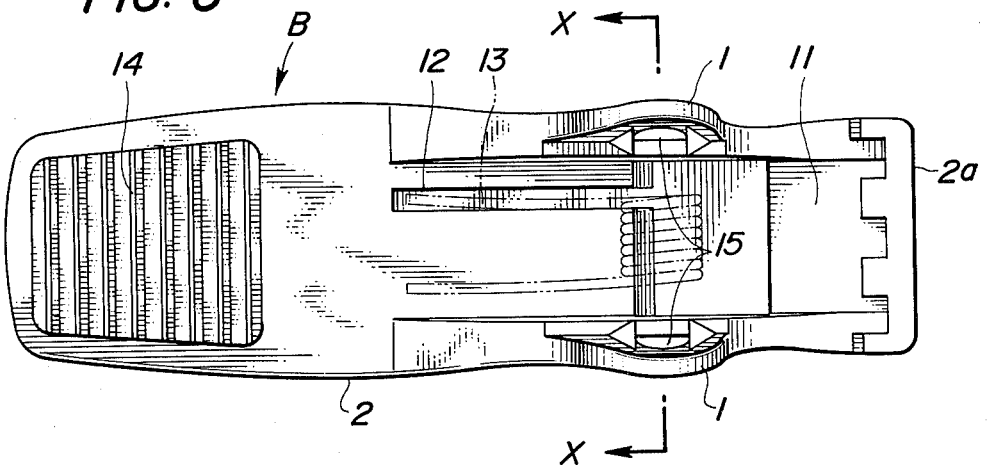
FIG. 6 is a plan view of the lower clip member of the embodiment of FIG. 1.
Figure 7:
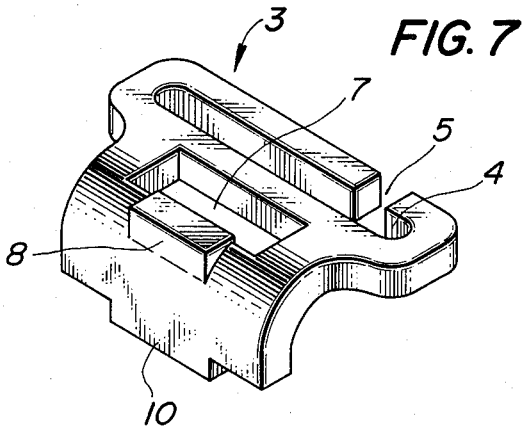
FIG. 7 is a perspective view of the closing member of the embodiment of FIG. 1.
Figure 8:
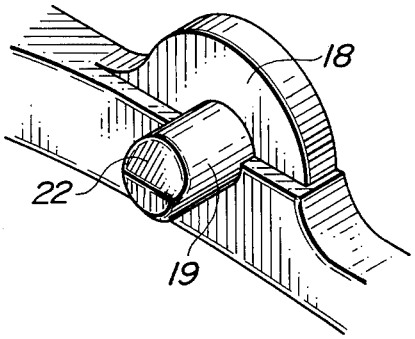
FIG. 8 is an enlarged perspective view of the side wall of the upper clip member of FIG. 5.

In FIGS. 1 to 9, an upper clip member A comprises a plate portion 6 and is provided with a pair of opposed side walls 18 projecting vertically from the substantially middle portions of the back parts of longitudinal side edges of the plate portions 6, the side walls 18 being formed integrally with the plate portions 6. From the side walls 18 there are projecting laterally outwardly a pair of journals 19 each comprising a rod-shaped projection which is integral with the side walls. The journal is not necessarily in the form of a rod-shaped projection but may be a hemispherical projection, of course. The end portion of each journal 19 on the side opposing to the lower clip member B is preferably provided with a beveled face 22 functioning as a guide means. The provision of the beveled face 22 to each journal 19 facilitates to fit each journal 19 of the upper clip member A into the corresponding bearing portion of a lower clip member B and prevents the clip from being damaged when fitting. At the rear end **6*a* of the plate portion 6 of the upper clip member A, a recess 9 is provided for permitting a clip-engaging portion 8 of a closing member 3 mentioned below to slide therein and engage therewith. Further, the upper clip member A is provided with a groove 20 for receiving and securing one of the extended portions of a spiral spring member 13 functioning as a spring means. Furthermore, numeral 21** indicates a jagged anti-slipping means at the clipping end portion at the front part of the upper clip member A, which is integral with the member A or a separate member formed of rubber or the like and attached thereto.

A lower clip member B comprises a plate portion 2 and is provided with a pair of opposed side walls 1 projecting gradually outwardly or divergently from the substantially middle portion of the back parts of longitudinal side edges of the plate portion 2. The pair of side walls 1 are so provided as to correspond to the side walls 18 of the upper clip member A and as to permit the insertion of the pair of side walls 18 therebetween. The pair of side walls 1 are provided with bearing portions 15 respectively in the form of openings. The pair of bearing portions 15 are adapted to rotatably receive the pair of journals 19. Further, each side wall 1 may have on the inner surface thereof an integrally formed groove 16 extending from the top thereof to the bearing portion 15 as a guide means for guiding the insertion of the journal 19 into the bearing portion 15.

Figure 10:
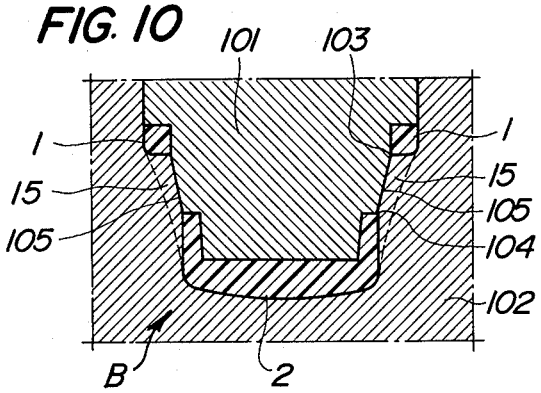
FIG. 10 is a sectional view of the lower clip member taken along line X — X of FIG. 6.
Figure 9:
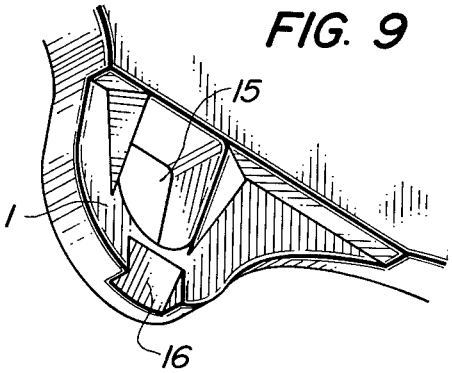
FIG. 9 is an enlarged perspective view the side wall of the lower clip member of FIG. 6.

The lower clip member B and especially the side walls 1 thereof are integrally formed in such a manner as shown in FIG. 10. The belowmentioned particular molds 101, 102 i.e. jigs for integrally molding are adapted to form the bearing portions 15 simultaneously with the lower clip member B. The contact surface 105 between the molds 101, 102 is preferably inclined outwardly. This contact surface may also be vertical to the plate portion 2, if necessary. Consequently, the uppermost point 103 of the inner peripheral edge of each bearing portion 15 which is an opening formed by the molds 101, 102 is located outside the imaginary plane vertical to the plate portion including the lowermost point 104 of the outer peripheral edge of the bearing portion. By integrally molding the lower plate member B using such molds 101, 102, the bearing portions 15 can be formed at the same time.

The rear end portion of the lower clip member B is bent so as to form a L-shaped rear end wall 2a. This L-shaped rear end wall 2a prevents the closing member 3 from being disengaged. That is, the rear end wall 2a is adapted to prevent the closing member, which is mounted between the rear end portions of the upper and lower clip members, to be disengaged rearwardly especially when taking the position of FIG. 2.

A recess 11 is provided integrally at the rear portion of the lower clip member B for the facilitation of the sliding movement of the closing member 3, and on the inner surface of the recess 11 there slides the clip-engaging portion 10 of the closing meber 3. Further, a groove 12 corresponds to the groove 20 of the upper clip member A and is integrally provided in the lower clip member B for the purpose of fitting and securing the spiral spring member 13. A jagged anti-slipping means 14 is provided on the clipping end portion of the lower clip member B at the front part of the lower clip member B, integrally with the clipping end portion or by additionally applying a separate member of rubber or other material.

The closing member 3 comprises the central opening 7, and a pair of projections i.e. clip-engaging portions 8, 10 which are formed vertical to the central opening 7, the opening 7 and the clip-engaging portions 8, 10 being integral with each other. Therefore, the closing member is substantially L-shaped when sectioned. The dimension of the central opening 7 is determined depending upon the width and thickness of the rear end portion 6a of the upper clip member A. That is, the width of the opening 7 is selected so that the rear end portion 6a can be passed therethrough without any hindrance.

When this clip is applied to a belt or the like, a slit 4 is provided at the rear end portion of the closing member 3 for fitting a looped end of the belt or the like. Further, a cutaway portion 5 may be provided at a part of the closing member 3 defining the slit 4 for communicating the slit with the outside. Such a closing member having the cutaway portion 5 facilitates the fitting of a preliminarily loop-formed end of a belt or the like.

While assembling the abovementioned members together into a clip, first the side walls 18 of the upper clip member A and the side walls 1 of the lower clip member B are put in an opposed relation and the two clip members are urged toward each other to force the side walls 1 of the clip member B laterally outwardly whereby the journals 19 are fitted into bearing portions 15 respectively. Since the side walls 1 of the lower clip member B are protruded not vertically but gradually outwardly, the side walls 1 are easy to be deformed outwardly, thus extremely facilitating the fitting of the journals 19 into the bearing portions 15. Once the journals 19 are fitted into the bearing portions 15, the side walls 1 restore the original state to prevent the disengagement of the journals 19 from the bearing portions 15 when the clip is in use.

The spiral spring member 13, is pushed into the grooves 12, 20 before or after the upper and lower clip members A and B are urged together to achieve the pivotal connection. The closing member 3 may be placed in the space defined by the rear end portions of the upper and lower clip members A, B, the side walls 1, 18 and the rear end wall 2a, after achieving the pivotal connection of the upper and lower clip members and fitting of the spiral spring member 13. When the closing member 3 is in the first position i.e. the opening 7 of the closing member 3 is positioned so as to be parallel with the plate portions of the upper and lower clip members A, B, the clip-engaging portion 10 urges the rear end of the lower member B against the force of the spiral spring member 13, whereby the clipping end portions of the clip members are closed. Namely, in the first position the clip-engaging portions 8, 10 of the closing member 3 is engaged so as to be substantially vertical to the clip members and in contact with each of the inner surfaces of the clip members. On the other hand, when the closing member 3 is pivoted from the first position to the second position, the clipping end portions are opened by the force of the spiral spring member 13. Namely, in the second position, the central opening 7 of the closing member 3 is substantially vertical to the clip members, while the clip-engaging portions 8, 10 are positioned substantially in parallel with the clip members, and the rear end portion 6a of the upper clip member A extends through the central opening 7 of the closing member 3.

According to the present invention, since a clip has the abovementioned construction, the characteristics of the plastic material can be made most use of, and a clip member having bearing portions can be easily formed, saving time and labor in manufacturing the clip to provide a low cost product. Further, the clip is of a high practical value.

What is claimed is:

1. A plastic clip comprising an elongated generally flat upper clip member having front and rear ends and a pair of longitudinally extending sides and a journal portion extending laterally outwardly from each of the sides, an elongated generally flat lower clip member having front and rear ends and a pair of longitudinally extending sides and a side wall extending upwardly and laterally outwardly from a portion of each of the sides, each of the side walls having an opening in which one of the journal portions of the upper clip member is rotatably positioned, the uppermost point of each of the openings in said side walls at the inside surface of the side wall being positioned laterally outwardly of the lowermost point of the opening at the outside surface of the side wall whereby the upper and lower members can be assembled by pushing the journal portions of the upper clip member downwardly between the side walls of the lower clip member until the journal portions are positioned in the openings in the side walls, a spring between the upper and lower clip members for resiliently biasing the front ends of the upper and lower clip members apart, and a closing member movably mounted between the rear ends of the upper and lower clip members for moving the front ends of the clip members together.

2. The clip of claim 1 in which the upper clip member includes a side wall extending downwardly from each side of the upper clip member, each of the journal portions being a cylindrical projection extending laterally outwardly from one of the side walls of the upper clip member and having a beveled outer end portion facing the lower clip member.

3. The clip of claim 1 in which each of the side walls of the lower clip member is provided with a groove in the inside surface thereof above the opening which is inclined downwardly and laterally inwardly.

* * * * *